United States Patent [19]

Reedy

[11] 4,429,552

[45] Feb. 7, 1984

[54] REFRIGERANT EXPANSION DEVICE

[75] Inventor: Wayne R. Reedy, Cazenovia, N.Y.

[73] Assignee: Carrier Corporation, Syracuse, N.Y.

[21] Appl. No.: 406,141

[22] Filed: Aug. 9, 1982

[51] Int. Cl.[3] ..... F25B 41/06

[52] U.S. Cl. ..... 62/528; 137/468; 138/45; 236/93 R; 236/101 R; 236/103; 251/118

[58] Field of Search ..... 62/511, 527, 528; 138/44, 45, 46; 251/118; 137/468; 236/93 R, 236/101 R, 103

[56] References Cited

U.S. PATENT DOCUMENTS

| | | | |
|---|---|---|---|
| 1,768,558 | 7/1930 | Andrews | 62/528 |
| 2,319,498 | 5/1943 | Gerard | 138/40 |
| 2,363,140 | 11/1944 | Persons | 138/40 |
| 2,418,671 | 4/1947 | Schweller | 138/45 |
| 2,437,287 | 9/1948 | Woods | 138/45 |
| 2,512,956 | 6/1950 | Mategorin | 138/45 |
| 2,859,768 | 11/1958 | Teague, Jr. | 137/468 |
| 3,154,105 | 10/1964 | Hilgert | 138/46 |
| 3,877,248 | 4/1975 | Honnold, Jr. | 62/511 |
| 3,992,898 | 11/1976 | Duell et al. | 62/527 |
| 4,262,844 | 4/1981 | Sekiya | 138/45 |
| 4,345,234 | 8/1982 | Reich | 236/101 R |

*Primary Examiner*—Ronald C. Capossela
*Attorney, Agent, or Firm*—David L. Adour

[57] ABSTRACT

A refrigerant expansion device for use in a vapor compression refrigeration system is disclosed. The device has a body portion with a bore extending therethrough. At least that portion of the body portion which forms the bore walls is made of a shape memory alloy which undergoes a metallurgical transformation at a predetermined transformation temperature to change the bore size of the device in response to the temperature of refrigerant flowing through the device. In this manner, the bore size of the device is adjusted in response to different operating conditions of the refrigeration system.

5 Claims, 4 Drawing Figures

REFRIGERANT EXPANSION DEVICE

BACKGROUND OF THE INVENTION

The present invention relates to vapor compression refrigeration systems and more particularly relates to refrigerant expansion devices for use in such systems.

There are many situations in which it is desirable to change the bore (restriction) size of a refrigerant expansion device in response to the temperature of the refrigerant passing through the device. For example, an air conditioner or a heat pump used to cool a house may have a refrigerant expansion device, located inside the house, for controlling refrigerant flow from an outdoor heat exchange unit to an indoor heat exchange unit. If the outdoor ambient temperature is relatively high then there may be some floodback of liquid refrigerant to the compressor because of the relatively small pressure drop across the refrigerant expansion device due to the relatively high temperature and pressure of the liquid refrigerant flowing to the device from the outdoor heat exchange unit. Floodback is prevented if there is a decrease in bore size of the refrigerant expansion device in response to an increase in temperature of the refrigerant flowing through the device. The smaller bore size increases the pressure drop across the device to ensure that all the liquid refrigerant flowing to the indoor heat exchange unit is vaporized.

Also, in a home heat pump system having an outdoor refrigerant expansion device, when the system is operating in the heating mode it is desirable to increase the bore size of the refrigerant expansion device in response to a relatively low temperature refrigerant flowing through the device to maintain proper system operation under conditions such as a large reduction in indoor temperature during a period of thermostat setback. This is true because normally in the heating mode the liquid refrigerant flowing from the indoor heat exchange unit to the outdoor heat exchange unit is at a temperature slightly above the indoor air temperature and this liquid refrigerant will become cooler with decreasing indoor air temperatures experienced during periods of thermostat setback. This decrease in temperature of the liquid refrigerant flowing to the outdoor heat exchange unit may result in undesirable frosting over of the outdoor heat exchange unit and/or an undesirable reduction in vapor flow to the compressor. These undesirable events may be prevented by increasing the bore size of the outdoor refrigerant expansion device, thereby increasing the rate of refrigerant flow to the outdoor heat exchange unit during such periods of reduced condensing temperature and increased subcooling.

Further, in a heat pump system having an indoor expansion device, it is desirable to increase the bore size of the device in response to relatively low refrigerant temperatures during the initial portion of defrost cycles. This is true because upon initiation of a defrost cycle, the heat pump system operates with a very low discharge pressure due to the relatively cold outdoor heat exchange unit which results in relatively cold liquid refrigerant flowing from the outdoor heat exchange unit to the indoor heat exchange unit.

This low discharge pressure results in less than a desirable amount of refrigerant flow through the expansion device. Defrost performance is improved by increasing the bore size of the refrigerant expansion device during the first portion of the defrost cycle and then changing to normal bore size later in the defrost cycle when the outdoor heat exchange unit begins to warm.

There are refrigerant expansion devices which may be suitable for use in the above-described situations. For example, temperature responsive capillary tubing and other such devices made from dissimilar metals having different thermal expansion coefficients may be used to provide an expansion device having a bore size which changes in response to the temperature of the liquid flowing through the device. However, the bore size of these devices does not undergo a single dramatic change at a given temperature bit, instead, undergoes continuous change depending on the temperature of the device. Also, these devices are relatively complex in structure and relatively difficult to manufacture because of the necessity for joining the dissimilar metals to form a bore having temperature sensitive walls made of the dissimilar metals. Special cuts, notches, and other configurations for the metals are usually required to produce special shapes for the bore walls so that the walls are temperature responsive. Also, the dissimilar metals are usually joined by welding, brazing, or soldering thereby requiring special manufacturing steps.

SUMMARY OF THE INVENTION

Therefore, an object of the present invention is to provide a relatively simple refrigerant expansion device which changes bore size at a given temperature.

Another object of the present invention is to simplify the structure and manufacture of refrigerant expansion devices having a bore which changes between two different sizes depending on the temperature of the refrigerant flowing through the device.

A further object of the present invention is to provide a refrigerant expansion device having a bore which changes between two different sizes depending on the temperature of the refrigerant flowing through the device, wherein the device is made of a single material.

These and other objects of the present invention are attained by a refrigerant expansion device having a body portion made of a shape memory alloy, such as a copper-zinc-aluminum shape memory alloy. The body portion of the device may be made entirely of the shape memory alloy or just a section surrounding the bore of the body portion of the device may be made from the alloy. The alloy is heat treated and properly shaped to undergo a metallurgical transformation from one structure to another to change the bore size of the device depending on whether the temperature of the device is greater than or less than a preselected transformation temperature. When the expansion device is used as part of a refrigeration system the bore size is changed in response to different operating conditions by appropriately selecting the transformation temperature.

BRIEF DESCRIPTION OF THE DRAWINGS

Other objects and advantages of the present invention will be apparent from the following detailed description in conjunction with the accompanying drawings in which.

DESCRIPTION OF THE PREFERRED EMBODIMENT

Figure 1:
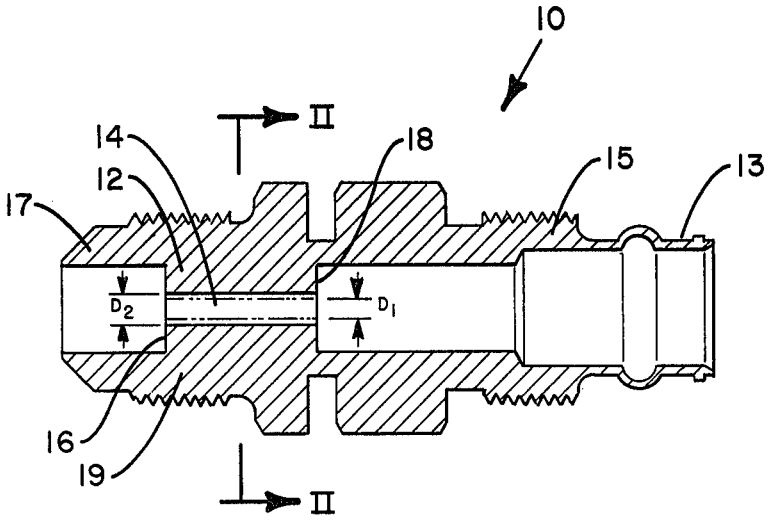
FIG. 1 is a cross-sectional view of a refrigerant expansion device made of a shape memory alloy according to the principles of the present invention.

Referring to FIG. 1, there is shown a cross-sectional view of a refrigerant expansion device 10 made of a shape memory alloy according to the principles of the present invention. The device 10 may be used as part of a vapor compression refrigeration system (not shown) to control refrigerant flow between an evaporator and a condenser of the refrigeration system.

As shown in FIG. 1, the refrigerant expansion device 10 includes an expanded portion 13 for receiving a refrigerant line (not shown) from the condenser of the vapor compression refrigeration system. A threaded collar 15 is provided so that a coupling nut may be threaded onto the device 10 to secure a coupling member for the condenser refrigerant line to the device 10 in a fluid tight manner. Similarly, the opposite end of the refrigerant expansion device 10 has a flared portion 17 for receiving a refrigerant line (not shown) from the evaporator of the refrigeration system and a threaded collar 19 is provided so that a coupling nut may be threaded onto the device 10 to secure the evaporator refrigerant line to the device 10 in a fluid tight manner. Also, the refrigerant expansion device 10 includes a body portion 12 having a refrigerant expansion orifice or bore 14 extending therethrough to provide a restriction which controls refrigerant flow through the device 10.

The body portion 12 of the refrigerant expansion device 10 has a flat planar surface 16 facing the evaporator refrigerant line connection end of the device 10 and has another flat planar surface 18 facing the condenser refrigerant line connection end of the device 10. The flat planar surface 18 is oriented generally perpendicular to the direction of refrigerant flow through the device 10 and provides a sharp edged orifice effect which creates a very substantial pressure drop with respect to refrigerant entering bore 14. Normally, the remaining pressure drop which is usually required is relatively small, therefore the length of the bore 14 can be accordingly small.

According to the present invention, at least the section of the body portion 12 which forms the walls of the bore 14 is made of a shape memory alloy, such as a copper-base shape memory alloy. For example, the section may be made of a shape memory alloy composed of approximately 75% copper, 7% to 8% aluminum, with the remainder of the alloy being zinc. If desired, the entire device 10 may be made of a single piece of this shape memory alloy to facilitate construction of the device 10.

The shape memory alloy forms either an austenite or betamartensite structure depending on the temperature of the shape memory alloy. Therefore, given the proper change in temperature, the alloy undergoes a metallurgical transformation from one structure to the other. If the alloy is properly heat treated and shaped while in one state, then converted through a change in temperature to the other state and reworked into a second shape while in that state, the alloy will "remember" both shapes and convert between them as a function of temperature. This transformation is completely reversible and repeatable. The transformation temperature is dependent on the composition of the material and may be formulated to have any value between −100° C. and +100° C. Also, any given shape change can be accomplished by passing through the transformation temperature in either direction.

By properly conditioning the shape memory alloy, the refrigerant expansion device 10 will provide a first selected refrigerant flow restriction when the temperature of the device 10 is equal to or less than the predetermined transformation temperature and will provide a second selected refrigerant flow restriction when the temperature of the device 10 is greater than the predetermined transformation temperature. For example, referring to FIG. 2, the body portion 12, which is made of the shape memory alloy, may be conditioned so that the bore 14 changes its cross-sectional diameter in response to refrigerant flowing through the bore 14 of the device 10. Thus, the bore 14 has a uniform diameter, $D_2$, which provides a first selected refrigerant flow restriction when the temperature of the refrigerant flowing through the device 10 is equal to or less than the predetermined transformation temperature for the shape memory alloy and has a smaller uniform diameter, $D_1$, which provides a second selected refrigerant flow restriction when the temperature of the refrigerant flowing through the device 10 is greater than the predetermined transformation temperature. Of course, in practice the change in diameter of the bore 14 is not completely discontinuous at the transformation temperature but, instead, occurs over a fine temperature interval which usually is only a small percentage of the temperature range over which the expansion device 10 operates. However, it should be noted that in certain applications it may be desirable to select a shape memory alloy whereby the shape transformation occurs over a relatively large temperature interval thereby providing a continuously varying restriction over this interval in response to temperature.

A temperature responsive refrigerant expansion device 10 as described above is especially useful in situations such as those discussed previously. Namely, the device 10, or other such similar expansion device made of a shape memory alloy may be used in a heat pump or air conditioner to prevent floodback during periods of high outdoor ambient temperature operation, may be used in a heat pump to maintain proper operation of the heat pump under conditions of large reductions in indoor temperature during a period of thermostat setback, or may be used in a heat pump to provide a variable restriction during the defrost cycle of the heat pump. Such operations may be more easily understood by referring to the following hypothetical (paper) examples:

EXAMPLE I

Figure 3:
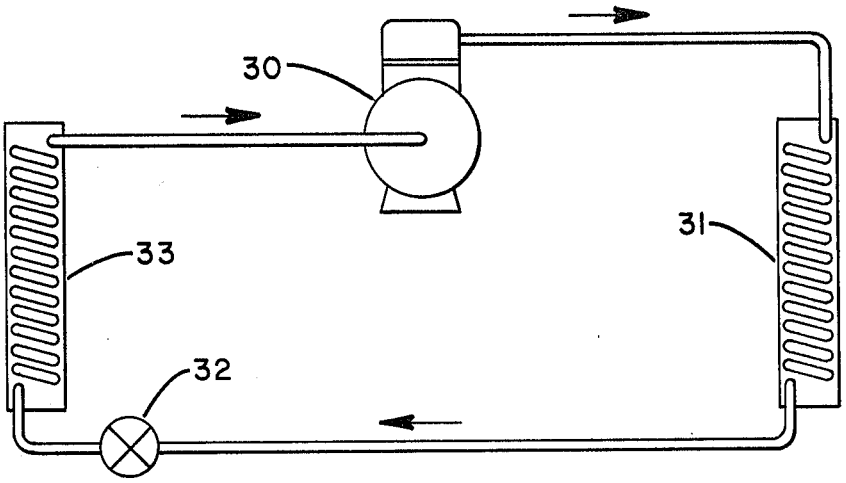
FIG. 3 is a schematic illustration of an air conditioning system using a refrigerant expansion device according to the principles of the present invention.

Referring to FIG. 3, a typical air conditioning system comprising a compressor 30, an outdoor heat exchange unit 31, an indoor refrigerant expansion valve 32, and an indoor heat exchange unit 33, is schematically shown. The arrows in FIG. 3 show the direction of refrigerant flow through the air conditioning system. The refrigerant flowing from the outdoor heat exchange unit 31 through the indoor refrigerant expansion valve 32 to the indoor heat exchange unit 33, typically may have a temperature varying from below 100° F. to above 130° F. depending upon factors such as the outdoor ambient air temperature. If the bore size of the refrigerant expansion device 32 is sized for optimal operation at refrigerant temperatures below 100° F. then it is desirable to reduce the bore size of the device 32 at refrigerant temperatures above 130° F. to ensure that all liquid refrigerant flowing to the indoor heat exchange unit 33 is vaporized thereby preventing floodback, that is, thereby preventing liquid refrigerant from the indoor heat exchange unit 33 from reaching the compressor 30. This may be accomplished by providing a refrigerant expansion device 32 with bore walls made of a shape memory alloy composed approximately of 75% copper, 18% zinc, and 7% aluminum which has a transformation temperature of about 120° F. so that the desired change in bore size is completely accomplished when the temperature of the liquid refrigerant flowing through the device 32 is above 130° F. Selecting a transformation temperature slightly below the actual desired shape transformation temperature is desirable because the actual shape transformation of the device 32 will normally occur over a finite temperature interval. Also, it should be noted that the transformation temperature of the shape memory alloy is very sensitive to the composition of the alloy and several different alloy compositions may provide the same transformation temperature. Therefore, it is to be understood that the alloy compositions given in these examples are only rough estimates of compositions which may actually be used in specific applications.

EXAMPLE II

Figure 4:
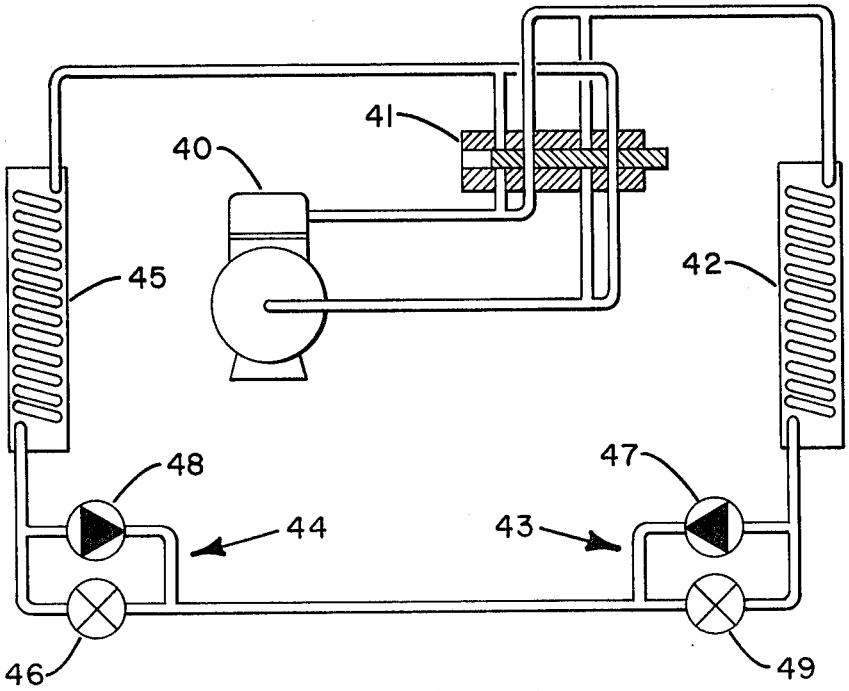
FIG. 4 is a schematic illustration of a heat pump system using a refrigerant expansion device according to the principles of the present invention.

Referring to FIG. 4, a typical heat pump system comprising a compressor 40, a four-way valve 41, an outdoor heat exchange unit 42, a first refrigerant expansion valve 43, a second refrigerant expansion valve 44, and an indoor heat exchange unit 45, is schematically shown. The refrigerant expansion valve 43 includes a refrigerant expansion device 49 and a bypass valve 47. Similarly, the refrigerant expansion valve 44 includes a refrigerant expansion device 46 and a bypass valve 48. When operating the heat pump system in the heating mode, bypass valve 48 is open and bypass valve 47 is closed thereby directing refrigerant flow through the refrigerant expansion device 49 but not through the refrigerant expansion device 46. The four-way valve 41 is positioned so that the compressor 40 compresses gaseous refrigerant received from the outdoor heat exchange unit 42, which is acting as an evaporator, and supplies this compressed refrigerant to the indoor heat exchange unit 45 which is acting as a condenser.

The bore size of the expansion device 46 is sized for optimal operation in the cooling mode when the heat pump system is operating as an air conditioner. Air conditioning operation normally occurs only during summer months at which time the refrigerant flowing through the expansion device 46 is at a temperature on the order of 100° F. However, during the heating season, when a defrost cycle is initiated for removing frost from the outdoor heat exchange unit 42, the bypass valve 47 is opened, the bypass valve 48 is closed, and the four-way valve 41 is positioned so that the outdoor heat exchange unit 42 is operating as a condenser and the indoor heat exchange unit 45 is acting as an evaporator. During the initial portion of the defrost cycle the heat pump system operates with a very low discharge pressure due to the relatively cold outdoor heat exchange unit 42 which results in relatively cold liquid refrigerant (on the order of 40° F.) flowing from the outdoor heat exchange unit 42 through the refrigerant expansion device 46 to the indoor heat exchange unit 45. Under these conditions it is desirable, during the initial portion of the defrost cycle, to increase the bore size of the refrigerant expansion device 46, then, later on in the defrost cycle when the outdoor heat exchange unit 42 is warmer and the refrigerant flowing through the refrigerant expansion device 46 is on the order of 60° F., it is desirable to return to normal bore size. This may be accomplished by using a refrigerant expansion device 46 having its bore walls made of a shape memory alloy composed approximately of 75% copper, 17.7% zinc, and 7.3% aluminum which has a transformation temperature of approximately 50° F. Proper preconditioning of this shape memory alloy will provide a refrigerant expansion device 46 having the desired shape transformation properties. That is, the device 46 will have a relatively large bore size during the initial portion of the defrost cycle when the temperature of the refrigerant flowing through the device 46 is on the order of 40° F., and will have a relatively small bore size later on during the defrost cycle, and during normal cooling mode operation, when the temperature of the refrigerant flowing through the device 46 is on the order or greater than 60° F.

Figure 2:
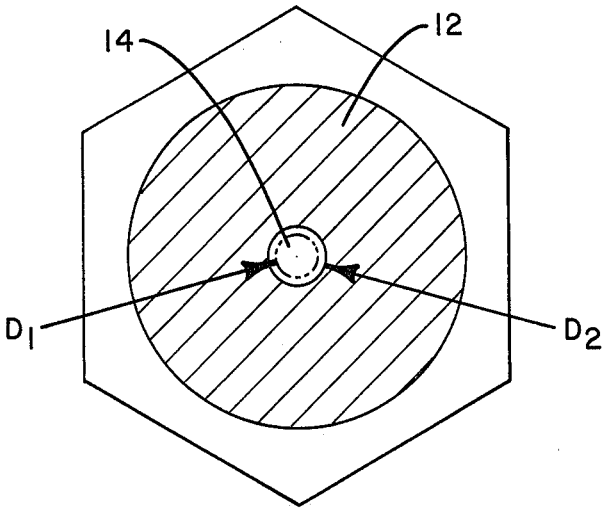
FIG. 2 is a cross section of the device shown in FIG. 1 along the line II—II. The dashed lines in the figure show the expansion device in an expanded state when the temperature of the device is greater than the transformation temperature for the shape memory alloy.

In conclusion, it should be noted that although the present invention has been described in conjunction with the particular refrigerant expansion device 10 depicted in FIGS. 1 and 2, and in conjunction with the specific systems shown in FIGS. 3 and 4, any of a variety of refrigerant expansion devices may be constructed from a shape memory alloy according to the principles of the present invention and these devices may be used in a variety of applications. The particular device and systems depicted and described herein are used only as illustrative examples for purposes of describing the present invention. Therefore, while the present invention has been described in conjunction with a particular embodiment it is to be understood that various modifications and other embodiments of the present invention may be made without departing from the scope of the invention as described herein and as claimed in the appended claims.

What is claimed is:

1. A refrigerant expansion device for use in a vapor compression refrigeration system, said refrigerant expansion device comprising:

a body portion having an opening therethrough to provide a refrigerant flow restriction when said body portion is connected in the refrigerant flow path of the refrigeration system, said body portion made of a conditioned shape memory alloy to provide a first selected refrigerant flow restriction when the temperature of the refrigerant flowing through the device is equal to or less than a predetermined transformation temperature, and to provide a second selected refrigerant flow restriction when the temperature of the refrigerant flowing through the device is greater than the predetermined transformation temperature.

2. In a vapor compression refrigeration system a refrigerant expansion device as recited in claim 1, wherein said body portion of said device comprises:

an elongate body section having a planar surface generally perpendicular to the direction of refrigerant flow; and an expansion orifice made of a shape memory alloy commencing at said planar surface and extending through said body portion, said orifice having a cylindrical bore of uniform diameter which provides the first selected refrigerant flow restriction when the temperature of the refrigerant flowing through the device is equal to or less than the predetermined transformation temperature and having a cylindrical bore of decreased uniform diameter which provides the second selected refrigerant flow restriction when the temperature of the refrigerant flowing through the device is greater than the predetermined transformation temperature.

3. In a vapor compression refrigeration system a refrigerant expansion device as recited in claims 1 or 2, wherein the shape memory alloy comprises a copper-zinc-aluminum alloy.

4. A heat transfer system comprising:

a compressor, a first heat exchange unit, a second heat exchange unit, and a refrigerant expansion device connected to form a vapor compression refrigeration circuit, said refrigerant expansion device having a body portion with an opening therethrough, said body portion made of a conditioned shape memory alloy to provide a first selected refrigerant flow restriction when the temperature of the refrigerant flowing through the device is equal to or less than a predetermined transformation temperature, and to provide a second selected refrigerant flow restriction when the temperature of the refrigerant flowing through the device is greater than the predetermined transformation temperature.

5. A heat transfer system as recited in claim 4 wherein the body portion of the refrigerant expansion device comprises a copper-zinc-aluminum shape memory alloy.

* * * * *